US007772513B2

(12) United States Patent
Ohda et al.

(10) Patent No.: US 7,772,513 B2
(45) Date of Patent: Aug. 10, 2010

(54) SWITCHGEAR AND SWITCHGEAR OPERATING MECHANISM

(75) Inventors: Yoshiaki Ohda, Kanagawa (JP); Yoshikata Kobayashi, Kanagawa (JP); Masaharu Shimizu, Kanagawa (JP); Satoshi Marushima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 506 days.

(21) Appl. No.: 11/898,418

(22) Filed: Sep. 12, 2007

(65) Prior Publication Data

US 2008/0078666 A1 Apr. 3, 2008

(30) Foreign Application Priority Data

Sep. 29, 2006 (JP) ..... 2006-268504

(51) Int. Cl.
*H01H 3/00* (2006.01)

(52) U.S. Cl. ..... 200/400; 200/318; 218/154

(58) Field of Classification Search ..... 200/400, 200/401, 500, 501, 318, 321–327, 335–337; 335/8–10, 21, 22, 26–29, 167–171, 189–192; 218/7, 14, 153, 154
See application file for complete search history.

(56) References Cited

U.S. PATENT DOCUMENTS

| | | | | |
|---|---|---|---|---|
| 3,600,541 | A * | 8/1971 | Goodwin, Jr. | 200/400 |
| 4,114,005 | A * | 9/1978 | Maier et al. | 200/400 |
| 4,301,436 | A * | 11/1981 | Castonguay et al. | 335/166 |
| 4,404,446 | A * | 9/1983 | Maier et al. | 200/320 |
| 4,968,861 | A | 11/1990 | Kuhn | |
| 5,113,056 | A | 5/1992 | Kuhn | |
| 5,650,663 | A | 7/1997 | Parthasarathi | |
| 6,472,627 | B1 | 10/2002 | Yoon | |
| 7,449,653 | B2 * | 11/2008 | Gibson et al. | 200/400 |

FOREIGN PATENT DOCUMENTS

| | | | |
|---|---|---|---|
| DE | 44 42 603 | A1 | 6/1996 |
| DE | 100 52 412 | A1 | 6/2001 |
| EP | 0 320 614 | A1 | 6/1989 |
| JP | 11-213824 | A | 8/1999 |
| JP | 2000-040445 | A | 2/2000 |
| JP | 3497866 | B2 | 11/2003 |

* cited by examiner

*Primary Examiner*—Renee Luebke
*Assistant Examiner*—Marina Fishman
(74) *Attorney, Agent, or Firm*—Foley & Lardner LLP

(57) ABSTRACT

A switchgear operating mechanism for reciprocatively driving a movable contact of a switchgear so as to shift the switchgear between an open state and a closed state. In the closed state, a roller pushes a leading end of a latch in the direction substantially toward the rotation center of the latch. In a state where the switchgear operating state is shifted from the closed state to the open state, a lock lever is pulled so as to allow the latch to be rotated in the opposite direction to the biasing direction of a latch return spring to release an engagement between the roller and the leading end of the latch, which causes the opening spring to discharge its energy to rotate the sub-shaft.

15 Claims, 10 Drawing Sheets

SWITCHGEAR AND SWITCHGEAR OPERATING MECHANISM

CROSS REFERENCE TO RELATED APPLICATION

The present invention contains subject matter related to Japanese Patent Application No. 2006-268504, filed in the Japanese Patent Office on Sep. 29, 2006, the entire content of which is incorporated herein by reference.

BACKGROUND OF THE INVENTION

The present invention relates to a switchgear for opening/closing an electrical circuit and its operating mechanism and, more particularly, to a switchgear and its operating mechanism suitably configured for cutting off high-voltage current in short time periods.

In general, there are available, as an operating mechanism of a switchgear, one using a hydraulic operating force for large power and one using a spring operating force for middle/small output power. The former is referred to as "hydraulic operating mechanism" and the latter as "spring operating mechanism". In recent years, the advancement of miniaturization of an arc-extinguishing chamber of a gas-insulated circuit breaker which is a type of a switchgear allows fault current to be broken with a smaller operating force, so that application of the spring operating mechanism becomes popular. However, a gas-insulated circuit breaker of extra high-voltage class requires high-speed operating capability called "2 cycle operation" that is capability of achieving opening within a time length corresponding to two-cycle time periods of alternating current. A conventional spring operating mechanism typically has operating capability equivalent to about 3 cycle operation, and it is not easy to realize the two-cycle opening capability due to poor responsiveness of a retention mechanism or retention control mechanism of a spring force.

A first type of conventional example of an operating mechanism of such a switchgear is disclosed in Japanese Patent Application Laid-Open Publication Nos. 11-213824 and 2000-40445 (the entire contents of which are incorporated herein by reference). In operation mechanisms disclosed in these documents, a force of a opening spring is retained by a retention mechanism constituted by a latch, O-prop (opening-hook lever), and a catch through an output lever. In this configuration, when a trip current is applied to a solenoid serving as a retention control mechanism, a plunger of the solenoid activates the catch to allow the engagement between the catch and prop to be released, which releases the engagement between the output lever and the latch to rotate the output lever to release the opening spring force, thereby achieving opening operation.

A second type of conventional example of the switchgear operating mechanism is disclosed in Japanese Patent No. 3497866 (the entire content of which is incorporated herein by reference). In a spring operating mechanism disclosed in this document, a pull-out lever and a retention lever are provided for retaining a opening spring force. In this configuration, the retention lever is activated not by the opening spring force but by a force of an acceleration spring at the opening operation time so as to release the opening spring force.

In the first type of conventional example, operation for releasing the opening spring force (opening operation) is constituted by the following three steps: operation of the catch driven by excitation of the solenoid, operation of the O-prop, and operation of electrical contacts including the opening spring. The operational relationship between the above components is shown in FIG. 10. The horizontal axis denotes time, and vertical axis denotes a stroke of each components. The lowermost curve represents the waveform of a trip current and, above this, the stroke of the catch is shown. Above this, the strokes of the O-prop and opening spring are shown. The uppermost curve represents an energizing signal of the contact in an arc-extinguishing chamber of a gas-insulated circuit breaker.

Time length from the start of application of the trip current until the operation of the O-prop is started along with the operation of the catch is assumed to be T1. Time length from the start of operation of the O-prop to the start of operation of the opening spring is assumed to be T2. Time length from the start of operation of the opening spring until the opening spring reaches its contact parting point is assumed to be T3. Assuming that contact parting time is T0, $$T0=T1+T2+T3 \tag{1}$$

is satisfied.

In order to realize 2 cycle operation, it is necessary to reduce contact parting time T0 to a given value. As is clear from FIG. 10, in a typical spring operating mechanism, operations of the components from the catch to the opening spring, which occur after the trip current application, are not started simultaneously. That is, the catch operates to some degree to release the engagement between itself and O-prop to thereby allow operation of the O-prop to be started, and opening spring starts operating after the O-prop operates to some degree. Thus, a mechanism that retains a opening spring force operates in a stepwise manner, so that it is necessary to reduce respective time lengths T1, T2, and T3 in order to reduce T0.

However, since the opening spring force is determined by the weight of a movable portion of the arc-extinguishing chamber, opening speed, and drive energy, there is a limit to a reduction of T3. With regard to T2, weight reduction of the O-prop and increase in a force (retention force) of retaining the opening force allows high-speed operation of the O-prop. However, when the retention force is increased, the size of the O-prop needs to be increased for strength, which limits the weight reduction of the O-prop. It follows that there occurs a limit in the improvement in operation speed relying on the increase in the retention force. Further, when the retention force is increased, a large force is applied to the engagement portion between the O-prop and catch, so that there occurs a need to increase the size of the catch for strength and to provide a solenoid having a large electromagnetic power for activating the catch.

At present, an excitation method using a large-sized condenser is adopted for obtaining a large power of the solenoid. However, the upper limit value for a current value flowing to the solenoid is specified in the standard, so that there is a limit in the improvement in the output power of the solenoid. As described above, it is difficult to reduce the contact parting time in the conventional spring operating mechanism.

Also in the second conventional example, operation for releasing the opening spring force is constituted by the following three steps: operation of a pull-off hook driven by an electromagnet; simultaneous operation of a reset lever, acceleration spring, and retention lever; and simultaneous operation of a pull-off lever and opening spring. In this example, the direction of a retention force (pressuring force) of the opening spring is made substantially coincident with the rotation center of the retention lever, thereby reducing a force required for the operation of the retention lever.

Further, the speed of movement of the retention lever, which is included in the above second step, is made higher by the accelerating spring to thereby reduce the operation time. However, it is physically difficult to reduce the operation time of the second step to zero and, therefore, it is difficult to significantly reduce the entire contact parting time, also in terms of the problems described in the first example.

Further, the direction of a pressuring force to a portion at which the pull-off lever and retention lever are engaged with each other is made substantially coincident with the rotation center of the retention lever, so that when an external vibration is applied to the retention lever to force the same to vibrate, the pull-off lever is rotated in the opening operation direction, and the opening operating mechanism may start operating without an opening command. Further, the direction of the pressuring force fluctuates with respect to the rotation center of the retention lever due to deformation of the engagement surface between a roller provided on the pull-off lever and the retention lever, so that when the pressuring force acts in the opening operation direction of the retention lever, the pull-off lever may be released without an opening command.

Further, although not described in Patent Document 3, it is just conceivable that the retention lever operates in the opening direction due to an impact force applied when the roller pushes aside the retention lever for reengagement in the closing operation to allow the opening operation to be started without an opening command. As described above, in the second example, it is difficult to significantly reduce the contact parting time and it is likely that a retention state of the opening spring becomes unstable.

BRIEF SUMMARY OF THE INVENTION

The present invention has been made to solve the above problems, and an object thereof is to provide a switchgear for opening/closing an electrical circuit and its operating mechanism in which retention/release of the opening spring force is performed by a combination of a latch and its malfunction preventing mechanism to reduce a time period for the opening spring force to be released so as to significantly reduce the entire contact parting time and, at the same time, stability and reliability of a retention state of the opening spring force are improved.

According to an aspect of the present invention, there is provided a switchgear operating mechanism for reciprocatively driving a movable contact of a switchgear so as to shift the switchgear between an open state and a closed state, the operating mechanism comprising: a frame; a closing shaft rotatably disposed relative to the frame; a main lever which is rotatably fixed to the closing shaft and which can be swung in conjunction with the movable contact; a opening spring which is disposed such that it accumulates energy when the switchgear operating state is shifted from the open state to the closed state in accordance with rotation of the closing shaft while the opening spring discharges its accumulated energy when the switchgear operating state is shifted from the closed state to the open state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which swingably fixed to the sub-shaft; a roller rotatably fixed to a leading end of the latch lever; a latch which is disposed so as to be rotated relative to the frame around a rotation axis substantially parallel to the rotation axis of the closing shaft; a kick lever which is disposed so as to be rotated relative to the frame around a rotation axis substantially parallel to the rotation axis of the latch; a lock lever which is connected to the latch and kick lever so as to be rotated around different rotation axes substantially parallel to the rotation axis of the latch; a latch return spring which biases the latch so as to rotate the latch in a predetermined direction; a lock lever return spring which biases the lock lever so as to push the latch in the biasing direction of the latch return spring; and a stopper which is fixed to the frame so as to restrict the rotation of the biasing direction of the latch return spring of the latch, wherein in the closed state, the roller pushes the leading end of the latch in the direction substantially toward the rotation center of the latch, and in a state where the switchgear operating state is shifted from the closed state to the open state, the lock lever is pulled so as to allow the latch to be rotated in the opposite direction to the biasing direction of the latch return spring to release an engagement between the roller and the leading end of the latch, which causes the opening spring to discharge its energy to rotate the sub-shaft.

According to another aspect of the present invention, there is provided a switchgear having a movable contact that can be moved in a reciprocating manner and an operating mechanism that reciprocatively drives the movable contact and which can be shifted between an open state and a closed state by the movement of the movable contact, the operating mechanism comprising: a frame; a closing shaft rotatably disposed relative to the frame; a main lever which is rotatably fixed to the closing shaft and which can be swung in conjunction with the movable contact; a opening spring which is disposed such that it accumulates energy when the switchgear operating state is shifted from the open state to the closed state in accordance with rotation of the closing shaft while the opening spring discharges its accumulated energy when the switchgear operating state is shifted from the closed state to the open state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with the rotation of the closing shaft; a latch lever which swingably fixed to the sub-shaft; a roller rotatably fixed to a leading end of the latch lever; a latch which is disposed so as to be rotated relative to the frame around a rotation axis substantially parallel to the rotation axis of the closing shaft; a kick lever which is disposed so as to be rotated relative to the frame around a rotation axis substantially parallel to the rotation axis of the latch; a lock lever which is connected to the latch and kick lever so as to be rotated around different rotation axes substantially parallel to the rotation axis of the latch; a latch return spring which biases the latch so as to rotate the latch in a predetermined direction; a lock lever return spring which biases the lock lever so as to push the latch in the biasing direction of the latch return spring; and a stopper which is fixed to the frame so as to restrict the rotation of the biasing direction of the latch return spring of the latch, wherein in the closed state, the roller pushes the leading end of the latch in the direction substantially toward the rotation center of the latch, and in a state where the switchgear operating state is shifted from the closed state to the open state, the lock lever is pulled so as to allow the latch to be rotated in the opposite direction to the biasing direction of the latch return spring to release an engagement between the roller and the leading end of the latch, which causes the opening spring to discharge its energy to rotate the sub-shaft.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Embodiments of an operating mechanism of a switchgear according to the present invention will be described below with reference to the accompanying drawings.

First Embodiment

Figure 1:
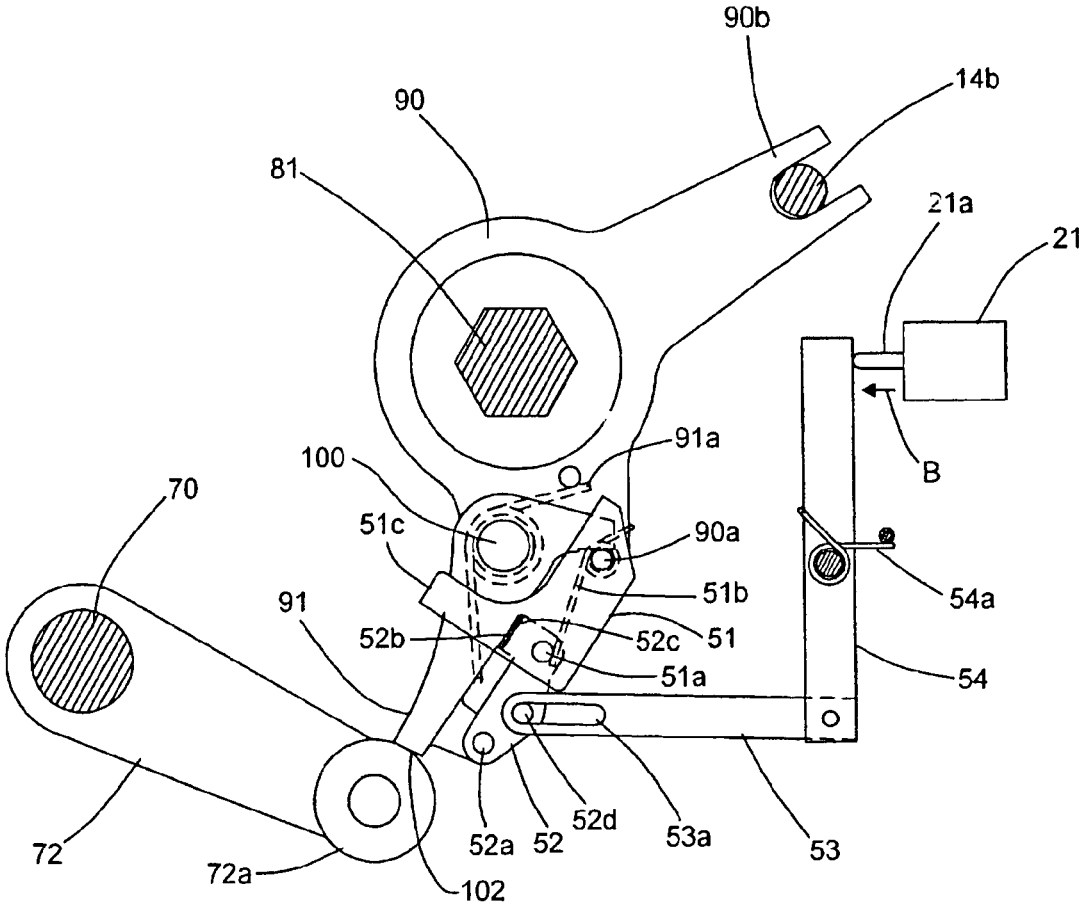
FIG. 1 is a front view showing a closed state of a retention unit and a retention control unit of a switchgear operating mechanism according to a first embodiment.
Figure 2:
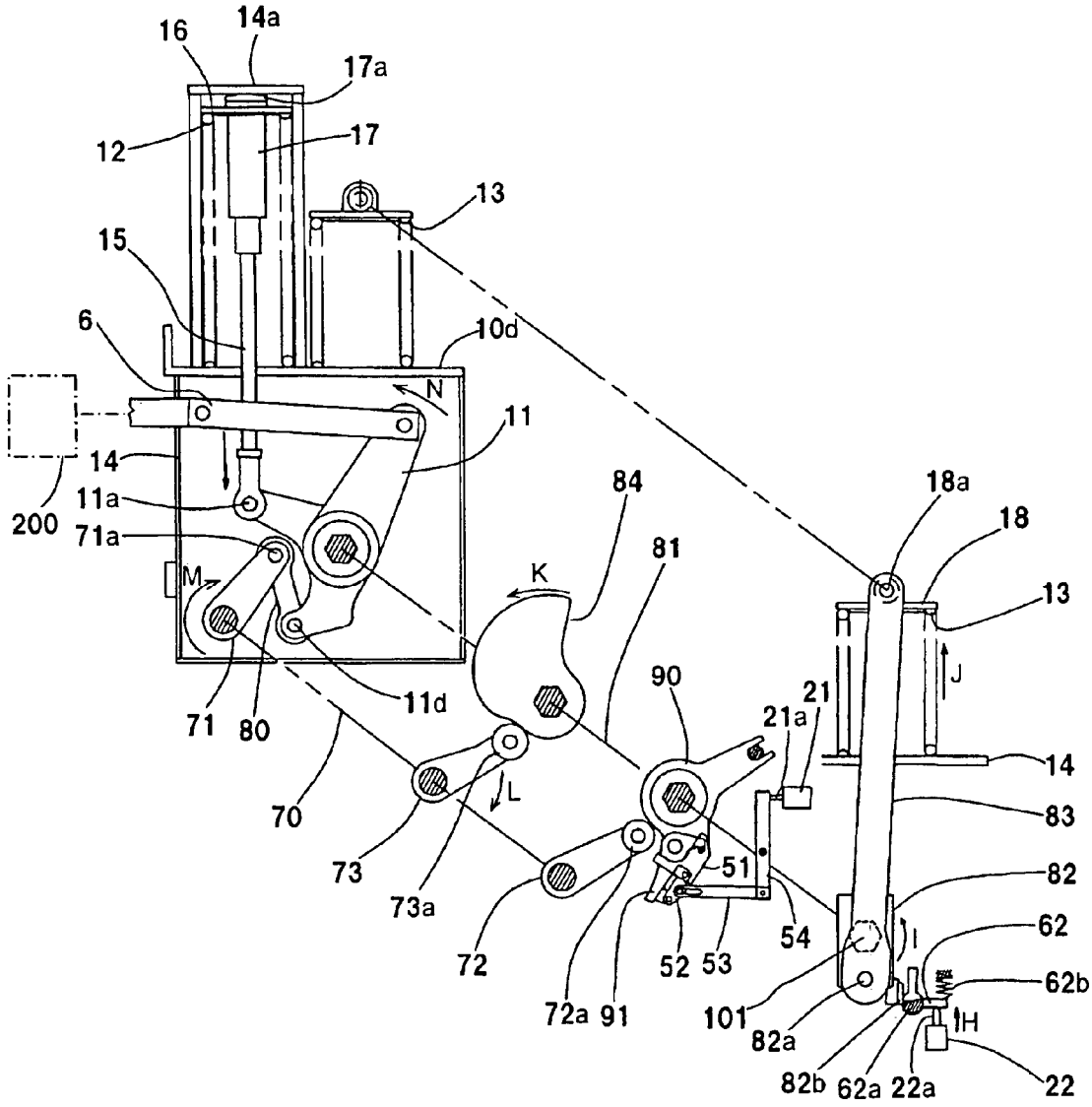
FIG. 2 is a developed front view showing an open state of a spring operating mechanism in the switchgear of FIG. 1.
Figure 3:
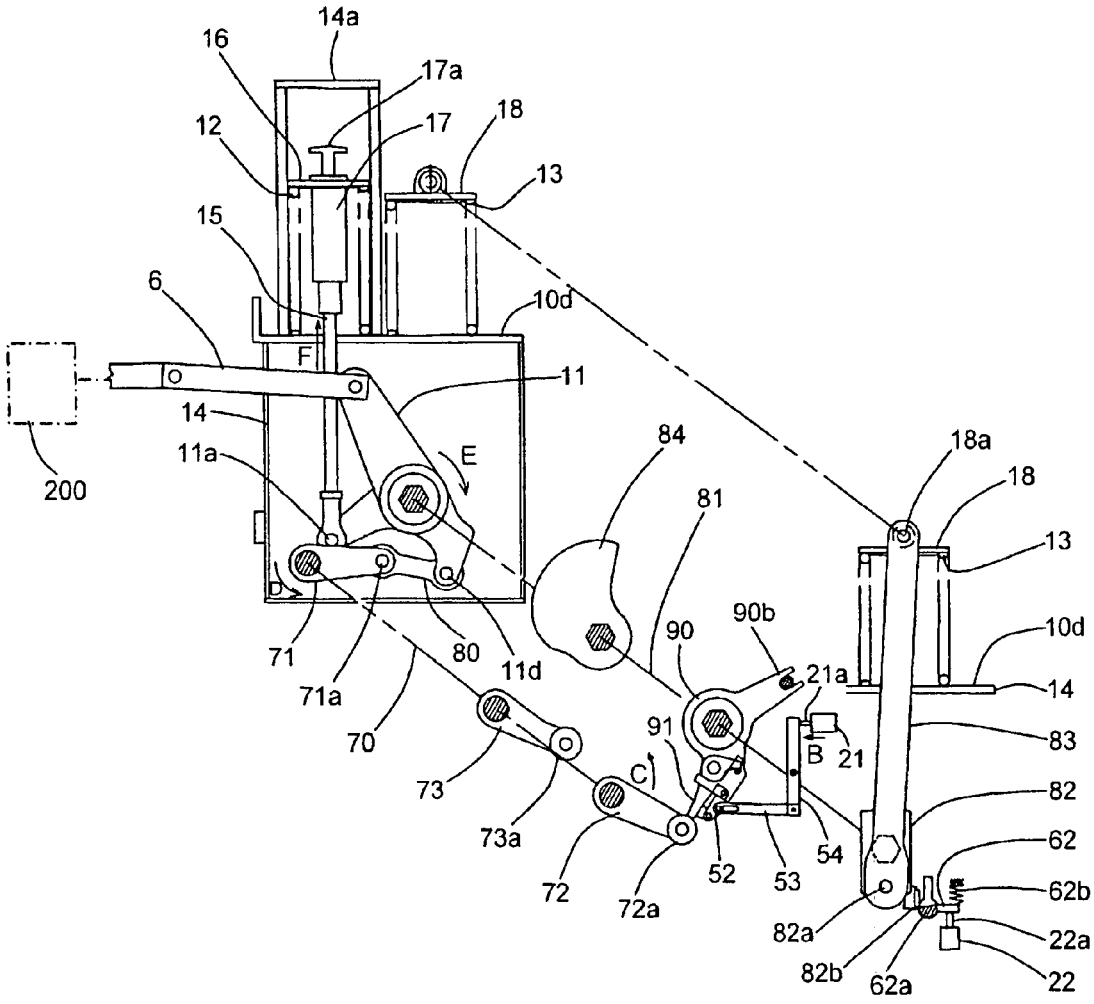
FIG. 3 is a developed front view showing a closed state of a spring operating mechanism in the switchgear of FIG. 1.
Figure 4:
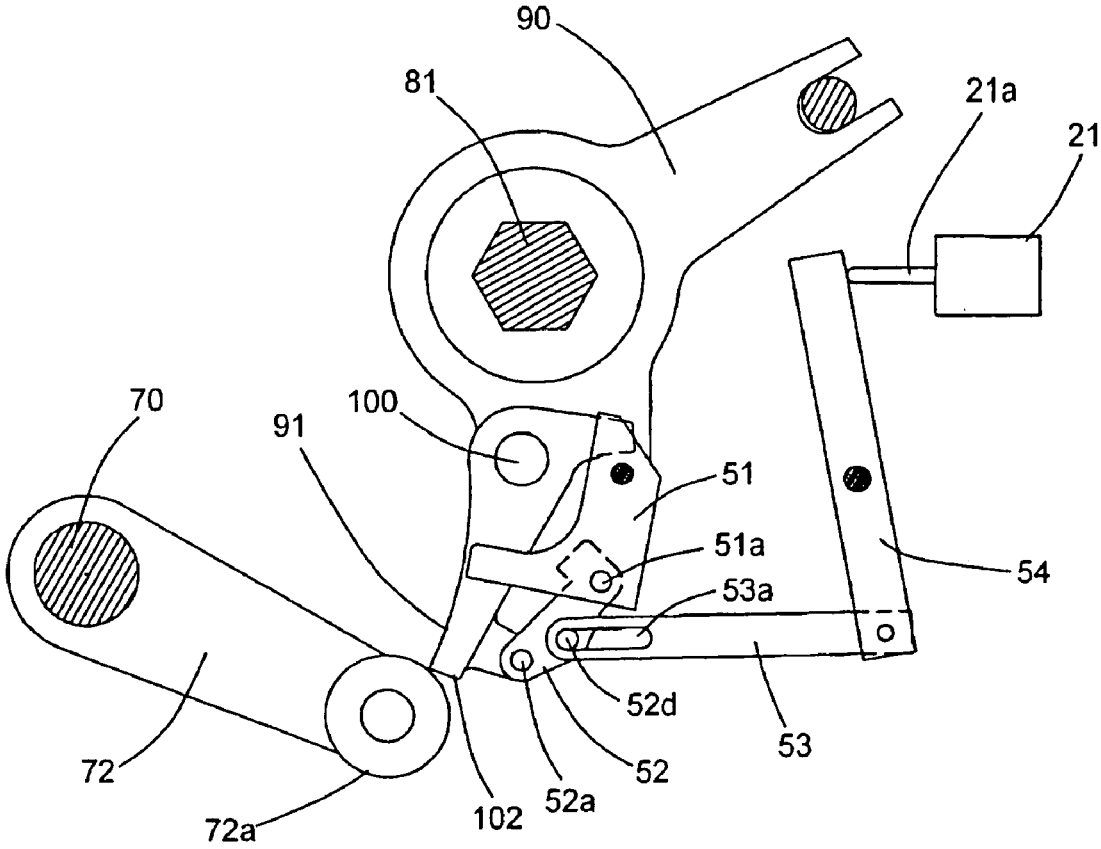
FIG. 4 is a main-part front view showing a state where a opening operation process of the switchgear is in progress.
Figure 5:
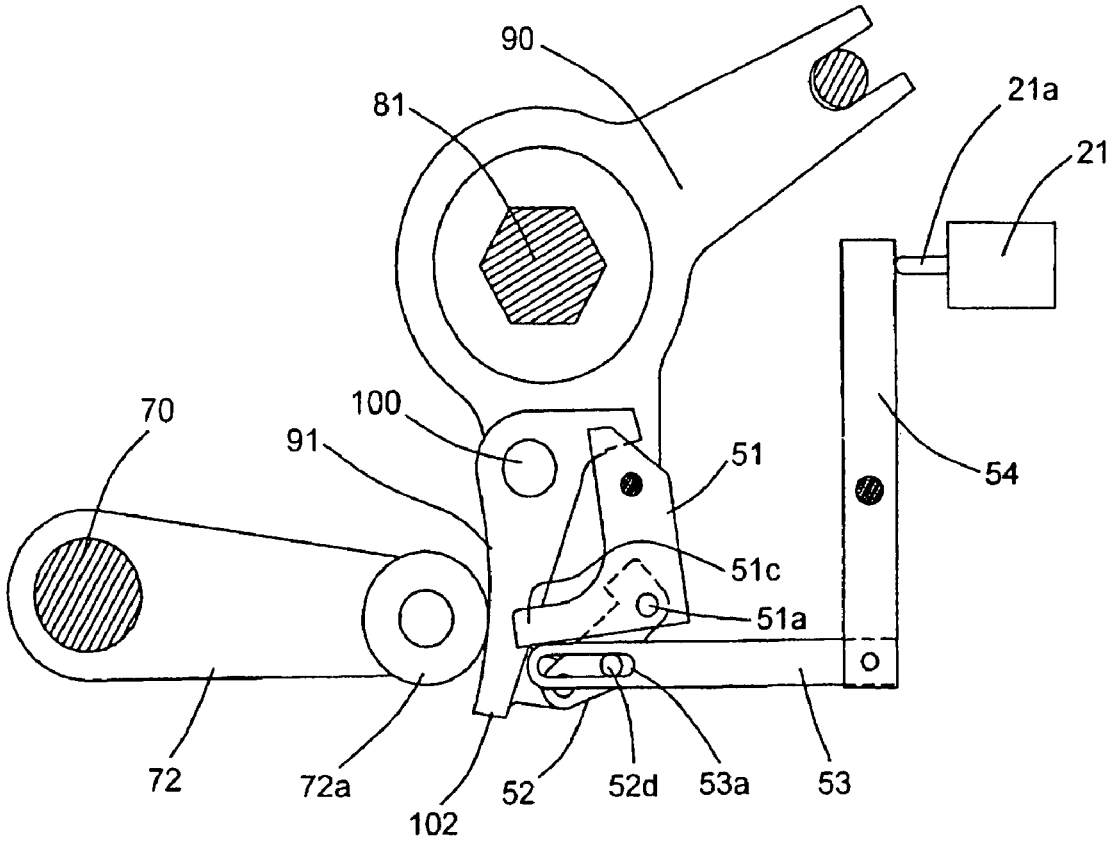
FIG. 5 is a main-part front view showing a state where a opening operation process of the switchgear is in progress following the state shown in FIG. 4.
Figure 6:
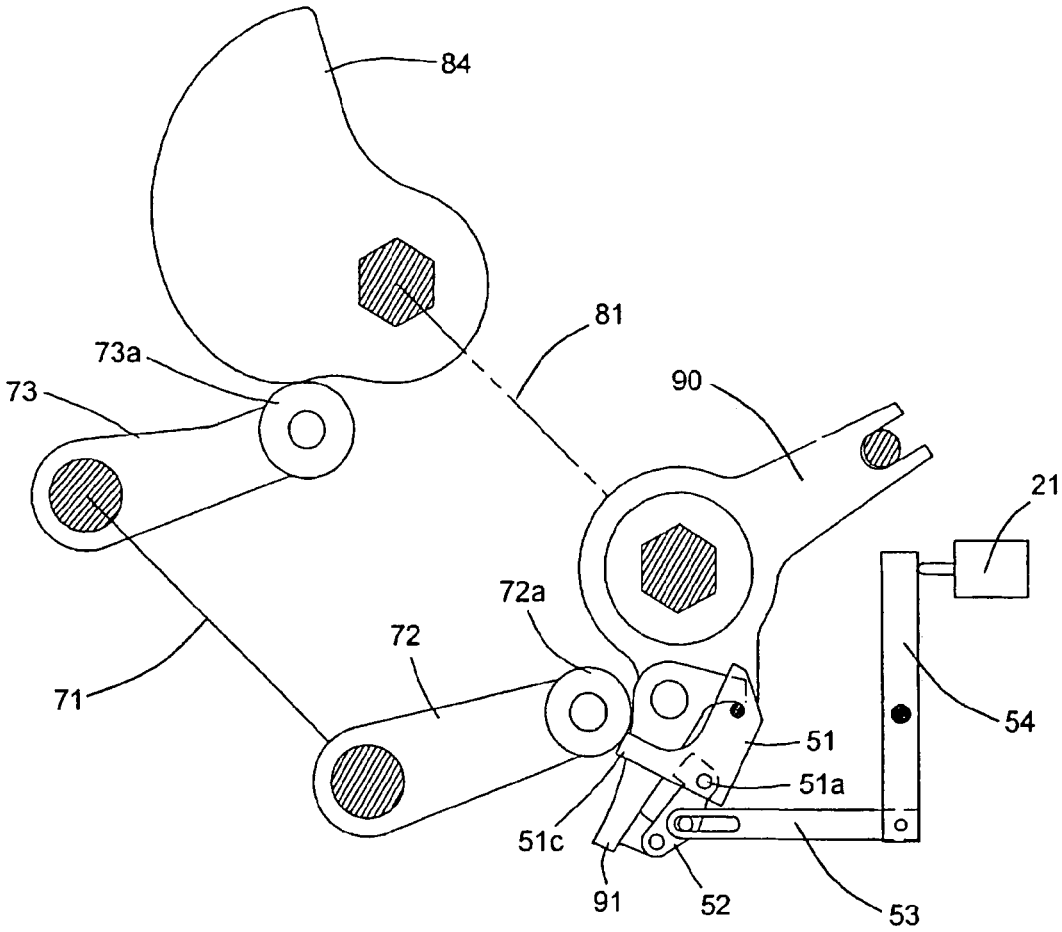
FIG. 6 is a main-part front view showing a state where a closing operation process of the switchgear is in progress.
Figure 7:
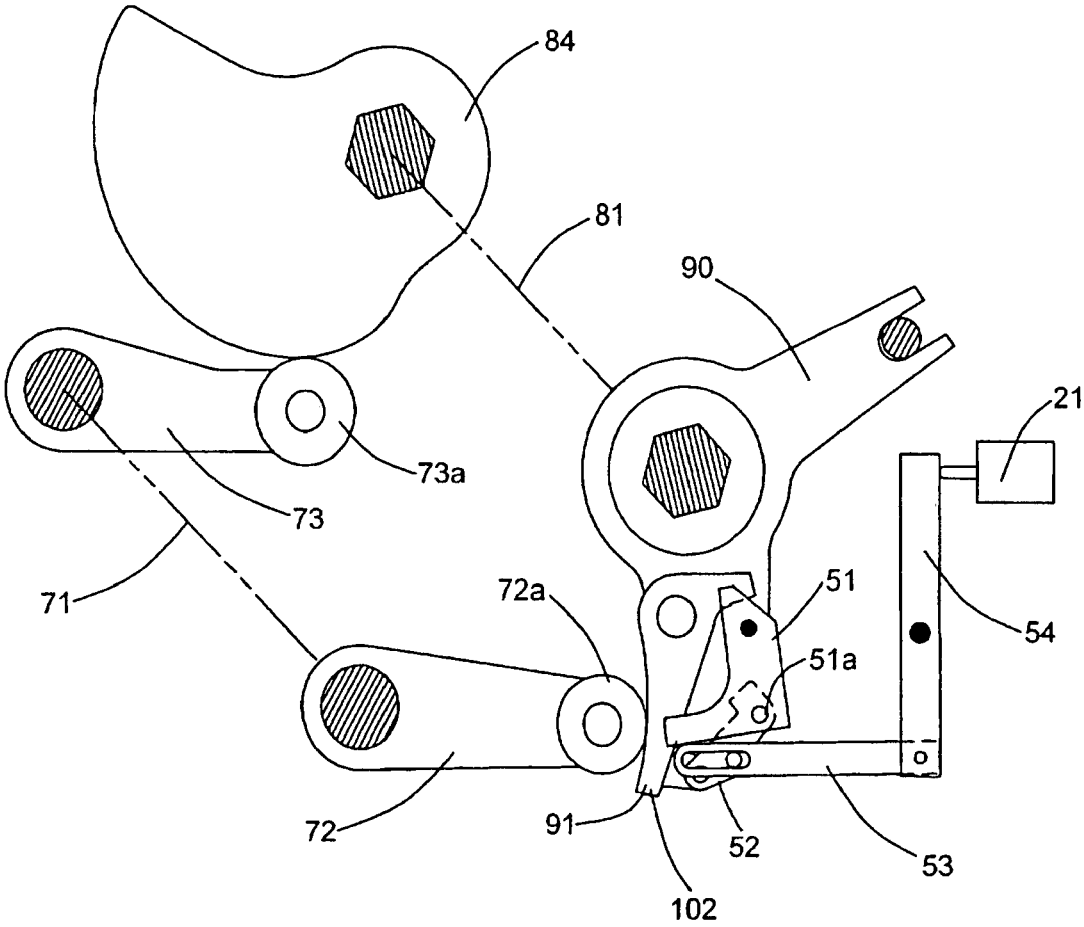
FIG. 7 is a main-part front view showing a state where a closing operation process of the switchgear is in progress following the state shown in FIG. 6.

First, with reference to FIGS. 1 to 7, a first embodiment of a switchgear operating mechanism according to the present invention will be described. FIG. 1 is a front view showing a closed state of a retention unit and a retention control unit of a switchgear operating mechanism. FIG. 2 is a view showing an open state of a spring operating mechanism including the units shown in FIG. 1. FIG. 3 is a view showing a closed state of a spring operating mechanism including the units shown in FIG. 1. FIGS. 4 and 5 are views showing a opening operation process from the closed state to the open state. FIGS. 6 and 7 are views showing a closing operation process from the open state to the closed state.

In FIGS. 2 and 3, a movable contact 200 is connected to the left side of a link mechanism 6. When the link mechanism 6 is moved in the right direction as shown in FIG. 2, the movable contact 200 becomes "open state" to achieve an open state. On the other hand, when the link mechanism 6 is moved in the left direction as shown in FIG. 3, the movable contact becomes "closed state". One end of the link mechanism 6 is rotatably engaged with the leading end of a main lever 11, and the main lever 11 is rotatably fixed to a closing shaft 81. The closing shaft 81 is rotatably supported by a bearing (not shown) fixed to a frame or a support structure 14.

A opening spring 12 has one end fixed to an attachment surface 10*d* of the frame 14 and the other end fitted to a opening spring receiver 16. A damper 17 is fixed to the opening spring receiver 16. In the damper 17, a fluid is encapsulated and a piston 17*a* is provided so as to translationally slide. One end of the damper 17 is fixed to a opening spring link 15, which is rotatably attached to a pin 11*a* of the main lever 11.

A sub-shaft 70 is rotatably disposed relative to the frame 14, and a sub-lever 71 is fixed to the sub-shaft 70. A pin 71*a* is disposed at the leading end of the sub-lever 71. A pin lid disposed in the main lever 11 and the pin 71*a* are connected by a main-sub connection link 80. A latch lever 72 is fixed to the sub-shaft 70, and a roller 72*a* is rotatably fitted to the leading end of the latch lever 72. Further, a cam lever 73 is fixed to the sub-shaft 70, and a roller 73*a* is rotatably fitted to the leading end of the cam lever 73.

A closing spring 13 has one end fixed to the attachment surface 10*d* of the frame 14 and the other end fixed to a closing spring receiver 18. A pin 18*a* is disposed in the closing spring receiver 18. The pin 18*a* is connected to a pin 82*a* of a closing lever 82 which is fixed to the end portion of the closing shaft 81 through a closing link 83. A closing cam 84 is fixed to the closing shaft 81 and releasably engaged with the roller 73*a* in accordance with the rotation of the closing shaft 81.

A tab 82*b* is disposed at one end of the closing lever 82 and is releasably engaged with a half-column portion 62*a* provided in an anchoring lever 62 for closing which is rotatably disposed relative to the frame 14. Further, a return spring 62*b* is disposed at one end of the anchoring lever 62 for closing. The other end of the return spring 62*b* is fixed to the frame 14. The return spring 62*b* is a compression spring and the spring force thereof always acts on the anchoring lever 62 for closing as a clockwise torque. However, the rotation of the anchoring lever 62 is restricted by an engagement between a plunger 22*a* of an electromagnetic solenoid 22 for closing which is fixed to the frame 14 and the anchoring lever 62 for closing.

In the open state shown in FIG. 2, a center 101 of the closing shaft 81 is displaced to the left relative to the center axis (or the axis connecting the centers of the pin 18*a* and the pin 82*a*) of the closing link 83, so that a counterclockwise torque is applied to the closing lever 82 by the closing spring 13. However, the rotation of the closing lever 82 is retained by an engagement between the tab 82*b* and half-column portion 62*a*.

A two-forked support portion 90*b* is formed at the leading end of an anchoring lever 90. The support portion 90*b* is engaged with a pin 14*b* which is fixed to the frame 14, which fixes the position of the anchoring lever 90 relative to the frame 14.

A latch 91 is rotatably disposed around a latch shaft pin 100 which is fixed to the end portion of the anchoring lever 90. A latch return spring 91*a* is disposed between the anchoring lever 90 and the latch 91. The latch return spring 91*a* always generates a clockwise torque for the latch 91. The clockwise rotation of the latch 91 is restricted by an abutment between a stopper pin (or a stopper) 90*a* disposed on the anchoring lever 90 and the latch 91. A leading end 102 of the latch 91 is formed by substantially a cylindrical surface, and the center position of the cylindrical surface substantially coincides with the rotation center of the latch 91, i.e., center axis of the latch shaft pin 100 or falls within the radius of the latch shaft pin 100.

A kick lever 51 is an L-like shaped plate. One end of the L-shape is rotatably disposed relative to the anchoring lever 90 so as to be positioned around the stopper pin 90*a*. The other end of the L-shape of the kick lever 51 is a protrusion portion 51*c* to be described later. A connection pin 51*a* is disposed at the curved (or turning) portion of the L-shape of the kick lever 51 and, through the connection pin 51*a*, the kick lever 51 and a lock lever 52 are rotatably engaged with each other. A pin 52*a* is disposed at the end portion opposite to the connection pin 51*a* and, through the pin 52*a*, the lock lever 52 and the latch 91 are rotatably engaged with each other.

A clockwise torque of a lock lever/kick lever return spring 51*b* always acts on the kick lever 51. This torque is received when an abutment surface 52*b* disposed on the lock lever 52 is engaged with the latch 91. A cushioning member 52*c* is fixed to the abutment surface 52*b*, which reduces a vibration generated when the lock lever 52 is engaged with the latch 91.

In the closed state shown in FIGS. 1 and 3, the center of the connection pin 51*a* is disposed on a line connecting the centers of the stopper pin 90*a* and the pin 52*a* or displaced to the latch 91 side. Therefore, when the latch 91 tries to rotate in the counterclockwise direction, the lock lever 52 and kick lever 51 push back the latch 91 to prevent the counterclockwise rotation. A protrusion portion 51*c* is formed in the kick lever 51, which is releasably engaged with the roller 72*a*.

A pull-off link mechanism has a pull-off link 53 and a pull-off lever 54 rotatably engaged with one end of the pull-off link 53. The pull-off link 53 has an elongated hole 53*a* at its end portion on the side opposite to the engagement portion with the pull-off lever 54. A lock lever pin 52*d* is disposed at substantially the intermediate portion between the connection pin 51*a* and the pin 52*a* on the lock lever 52. The lock lever pin 52*d* is engaged with the elongated hole 53*a*, allowing the lock lever 52 and pull-off link to be moved and rotated relative to each other within the range of the elongated hole 53*a*. The pull-off lever 54 is rotatably disposed relative to the frame 14 and always receives a clockwise torque by a pull-off return spring 54*a*.

The leading end of a plunger 21*a* of an electromagnetic solenoid 21 for opening which is fixed to the frame 14 is releasably engaged with the pull-off lever 54. Upon input of an opening command, the pull-off lever 54 is rotated in the counterclockwise direction.

In the closed state, the main lever 11 always receives a clockwise torque by a tensile spring force of the opening spring 12. The force transmitted to the main lever 11 is then transmitted to the sub-lever 71 through the main-sub connection link 80. The transmitted force becomes a torque for always rotating the sub-lever 71 in the counterclockwise direction. This counterclockwise torque is supplied also to the latch lever 72. However, in the closed state, the leading end 102 of the latch 91 and the roller 72*a* are engaged with each other to restrict the counterclockwise rotation of the latch lever 72. Accordingly, the subsequent members from the sub-lever 71 to the opening spring 12 maintain their static state.

In the present embodiment, the rotation shafts, such as the closing shaft 81 and sub-shaft 70, and axes of the respective pins are parallel to each other.

(Opening Operation)

In the present embodiment having the configuration described above, a opening operation from the closed state shown in FIGS. 1 and 3, through states shown in FIGS. 4 and 5, to the open state shown in FIG. 2 will be described. First, in the closed state shown in FIGS. 1 and 3, upon input of an external command, the electromagnetic solenoid 21 for opening is excited to move the plunger 21*a* in the direction of an arrow B. Since the pull-off lever 54 is engaged with the plunger 21*a*, it is rotated in the counterclockwise direction. In conjunction with the rotation, the elongated hole 53*a* is moved to the right while being engaged with the lock lever pin 52*d* to rotate the lock lever 52 in the clockwise direction. This state is shown in FIG. 4.

The pull-off link 53 rotates the latch 91 in the counterclockwise direction through the lock lever 52, which releases an engagement between the roller 72*a* and the leading end 102 of the latch 91. The latch lever 72 receives a counterclockwise torque from the opening spring 12, so that it is rotated in the counterclockwise direction while pushing the latch 91. At this time, the lock lever pin 52*d* is moved along the elongated hole 53*a* independently of operation of the pull-off link 53. In this state, the protrusion portion 51*c* of the kick lever 51 has been moved from the latch 91 side to the pull-off lever 54 side, so that it is not engaged with the roller 72*a*. This state is shown in FIG. 5.

FIG. 2 shows the end state of the opening operation. In this state, the kick lever 51 and the lock lever 52 have been returned to substantially the same position as those in the closed state (FIGS. 1 and 3) by the lock lever/kick lever return spring 51*b* (FIG. 1). Further, the pull-off link 53 and pull-off lever 54 have been returned to substantially the same position as those in the closed state by the pull-off return spring 54*a*. Furthermore, the latch 91 has been returned to substantially the same position as that in the closed state by the latch return spring 91*a*.

When an engagement between the latch 91 and the roller 72*a* is released in FIG. 3, the cam lever 73 and sub-lever 71, which are fixed to the latch lever 72 and sub-shaft 70, are rotated in the counterclockwise direction (denoted by arrows C and D). Then, the main lever 11 is rotated in the clockwise direction (denoted by an arrow E) to cause the opening spring 12 and damper 17 to be moved in the direction of an arrow F. Then, the link mechanism 6 and movable contact 200 connected to the link mechanism 6 are moved to the right to start the opening operation.

When the opening spring 12 is displaced by a given distance, the piston 17*a* is brought into contact with the stopper 14*a* fixed to the frame 14 to generate a braking power of the damper 17 to thereby stop the movement of the opening spring 12. The movements of the link levers connected to the opening spring 12 are accordingly stopped, thereby completing the opening operation. This state is shown in FIG. 2.

(Closing Operation)

Next, a closing operation from the open state shown in FIG. 2, through a state shown in FIGS. 6 and 7, to the closed state shown in FIGS. 1 and 3 will be described.

FIG. 2 shows a state where the closing spring 13 accumulates energy in the open state. Upon input of an external command, the electromagnetic solenoid 22 for closing is excited to move the plunger 22*a* in the direction of an arrow H. The anchoring lever 62 for closing is engaged with the plunger 22*a*, so that it is rotated in the counterclockwise direction. Then, the engagement between the half-column portion 62*a* and tab 82*b* is released. Accordingly, the closing lever 82 and the closing shaft 81 are rotated in the counterclockwise direction (denoted by an arrow I) by a spring force of the closing spring 13. The closing spring 13 is stretched in the direction of an arrow J and discharges its accumulated energy. The closing cam 84 fixed to the closing shaft 81 is rotated in the direction of an arrow K to be engaged with the roller 73*a*. When the roller 73*a* is pushed by the closing cam 84, the cam lever 73 is rotated in the clockwise direction (denoted by an arrow L) and, at the same time, the sub-lever 71 is rotated in the direction of an arrow M.

When the rotation of the sub-lever 71 is transmitted to the main lever 11, the main lever 11 is rotated in the counterclockwise direction (denoted by an arrow N). Then, the link mechanism 6 and movable contact 200 connected to the link mechanism 6 are moved to the left to start the closing operation. The opening spring 12 is compressed in association with the rotation of the main lever 11 to accumulate energy to establish an engagement between the roller 72*a* and the latch 91 once again, thereby completing the closing operation.

When the latch lever 72 is rotated in the clockwise direction in a state where the operation is shifted from the open state shown in FIG. 2 to the closing operation, the roller 72*a* is engaged with the protrusion portion 51*c* of the kick lever 51 in the first place. This engagement causes the kick lever 51 to be rotated in the counterclockwise direction and, accordingly, the lock lever 52 is rotated in the clockwise direction. This releases a pressing state between the kick lever 51 and the lock lever 52, allowing the counterclockwise rotation of the latch 91. This state is shown in FIG. 6.

FIG. 7 shows a state where the latch 91 is rotated further in the counterclockwise direction by the roller 72*a*. FIGS. 1 and 3 show a state where the closing operation has been completed.

When an engagement between the closing cam 84 and the roller 73*a* is released, the roller 72*a* is engaged with the leading end 102 of the latch 91 once again by the tension force of the opening spring 12. At this reengagement operation, a force acting from the roller 72*a* to the latch 91 is directed to substantially the rotation center of the latch 91. This is because that the leading end 102 of the latch 91 is formed by substantially a cylindrical surface, and the center position of the cylindrical surface substantially coincides with the rotation center of the latch 91 (i.e., center axis of the latch shaft pin 100). However, there is a possibility that the latch 91 is rotated in the counterclockwise direction due to lack of accuracy in the engagement surface, deformation of the engagement surface, or impact force at the time of engagement, to release the roller 72*a* from the latch 91. At this time, however, a pressing state between the kick lever 51 and the lock lever 52 have already been established by the lock lever/kick lever return spring 51*b*, which functions as a malfunction preventing mechanism to prevent the counterclockwise rotation of the latch 91.

According to the present embodiment, after the electromagnetic solenoid 21 for opening is excited upon input of an opening command, the opening operation is completed by two operation steps: a first operation step in which the latch 91 is directly driven through the pull-off lever 54 and pull-off link 53 to release an engagement between the latch 91 and the roller 72*a*; and a second operation step in which the opening spring 12 operates. As described above, the number of operations steps for completing the opening operation is reduced from three (in the case of conventional spring operating mechanism) to two, thereby significantly reducing the opening operation time. This means that T2 is removed from the expression (1) representing the contact parting time, so that it is possible to reduce the contact parting time.

Further, the lock lever 52 and the kick lever 51 can prevent a disengagement of the latch 91 due to an external vibration or a change in the retention direction resulting from deformation of the leading end 102 of the latch 91, thereby increasing operational reliability of the spring operating mechanism.

Further, the engagement surface of the leading end 102 of the latch 91 is formed by substantially a cylindrical surface, and the center position of the cylindrical surface substantially coincides with the rotation center of the latch 91 (i.e., center axis of the latch shaft pin 100), so that a torque of the roller 72*a* does not act on the latch 91 in the closed state. This allows miniaturization of the latch 91 to thereby minimize a force required for releasing the engagement between the latch 91 and the roller 72*a*, which can minimize the size of the electromagnetic solenoid.

Further, in the closed state, the connection pin 51*a*, which serves as the center axis of the rotation connection between the lock lever 52 and kick lever 51, is disposed on a line connecting the pin 52*a* and stopper pin 90*a*, so that the rotation of the latch can be stopped with a simple structure, contributing to miniaturization of the latch 91.

Further, by forming the protrusion portion 51*c* in the kick lever 51 and engaging the protrusion portion 51*c* with the roller 72*a* at the time of the closing, it is possible to realize an action for easily releasing a pressing state between the kick lever 51 and the lock lever 52 with a simple structure, contributing to miniaturization of the latch 91.

The elongated hole 53*a* is disposed at one end of the pull-off link 53, and the lock lever pin 52*d* disposed in the lock lever 52 and the elongated hole 53 are engaged with each other. This configuration simplifies the operation of the pull-off link 53. That is, it is only necessary for the pull-off link 53 to move the latch 91 until the engagement between the latch 91 and the roller 72*a* is released. Subsequent movement of the latch 91 is realized by the lock lever pin 52*d* moving the elongated hole 53*a*. As a result, it is possible to minimize the weight of the movable portion of the latch 91 to thereby reduce the time required for the latch 91 to return to the position of the closed state, enabling high speed operation.

By disposing the cushioning member 52*c* in the portion at which the lock lever 52 and the latch 91 are engaged with each other, it is possible to reduce a vibration generated when the lock lever 52 returns to the closed state. As a result, stable operation can be realized to increase operational stability and reliability of the operating mechanism.

Second Embodiment

Figure 8:
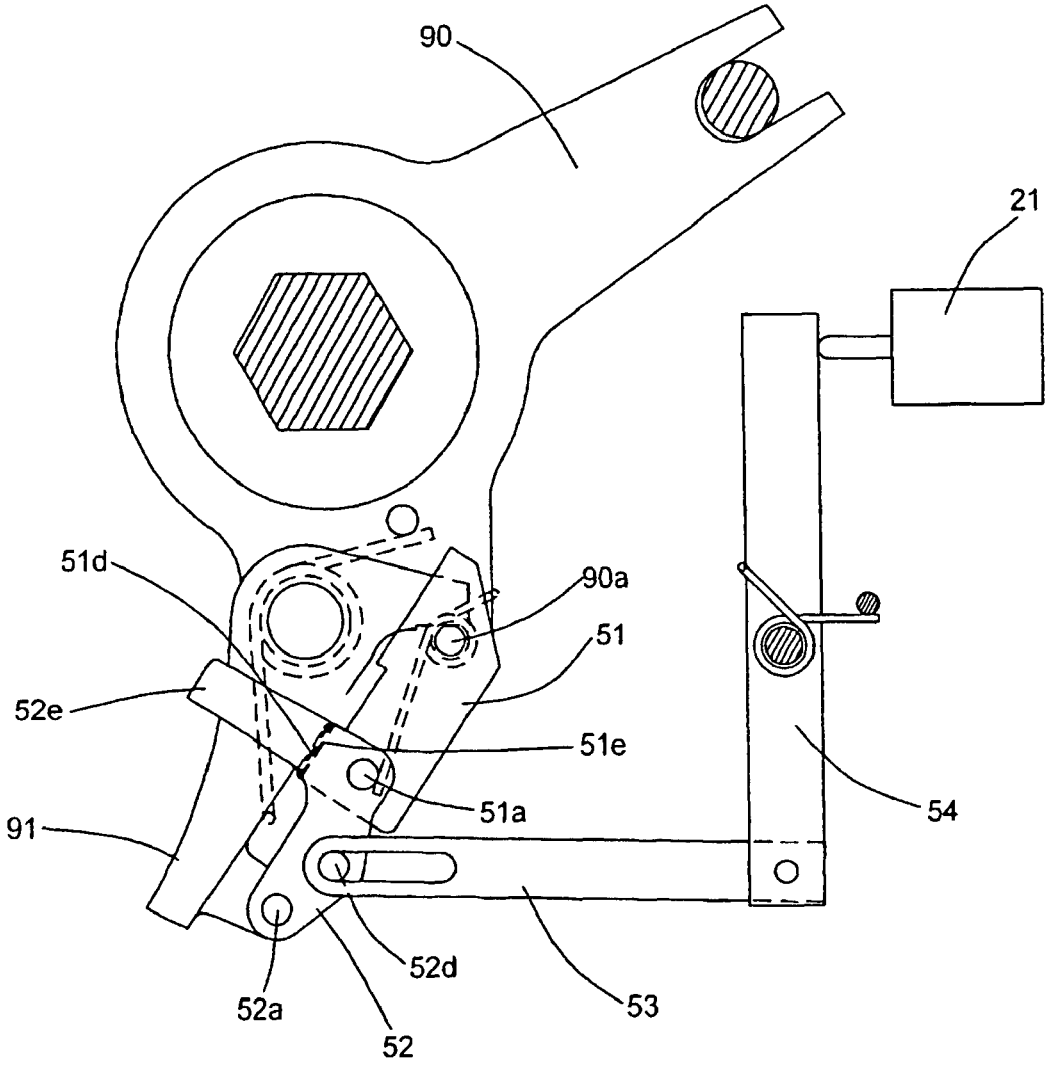
FIG. 8 is a front view showing a closed state of a retention unit and a retention control unit of a switchgear operating mechanism according to a second embodiment.

Next, with reference to FIG. 8, a second embodiment of a switchgear operating mechanism according to the present invention will be described. In FIG. 8, the same reference numerals as those in the first embodiment denote the same or corresponding parts as those in the first embodiment, and the repetitive description is omitted.

The present embodiment is obtained by partly modifying the lock lever 52 and kick lever 51 of FIG. 1. More specifically, as shown in FIG. 8, the lock lever 52 is formed into an L-like shape. The pin 52*a* is disposed at one end of the L-shape, and the lock lever 52 is rotatably engaged with the latch 91 around the pin 52*a*. The end portion on the side opposite to the pin 52*a* is formed as a protrusion portion 52*e* which is engaged with the roller 72*a* (see FIG. 1, etc.). The connection pin 51*a* is disposed at the curved (or turning) portion of the L-shape of the lock lever 52 and, through the connection pin 51*a*, the lock lever 52 and kick lever 51 are rotatably engaged with each other.

As in the case of FIG. 1, the kick lever 51 is rotatably disposed around the stopper pin 90*a* and is rotatably connected to the lock lever 52 by the connection pin 51*a*. However, in the present embodiment, the kick lever does not have the protrusion portion 51*c* (see FIG. 1, etc.) to be engaged with the roller 72*a* but has an abutment surface 51*d* to be engaged with the latch 91. A cushioning member 51*e* for absorbing an impact force is disposed on the abutment surface 51*d*.

The roller 72*a* is engaged with the protrusion portion 52*e* in the closing operation so as to release a pressing state between the kick lever 51 and lock lever 52.

The second embodiment having the above configuration can obtain the same effect as the first embodiment.

Third Embodiment

Figure 9:
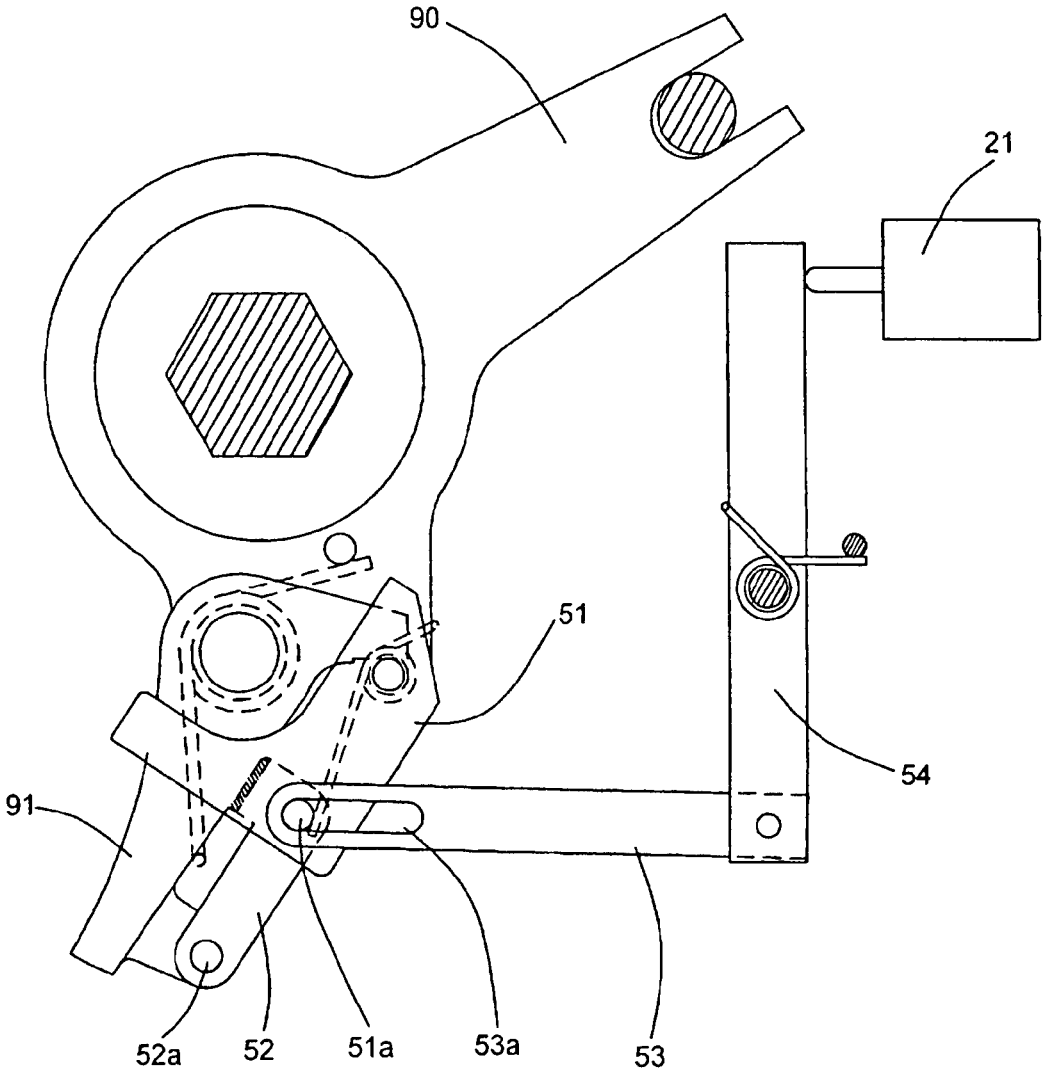
FIG. 9 is a front view showing a closed state of a retention unit and a retention control unit of a switchgear operating mechanism according to a third embodiment.
Figure 10:
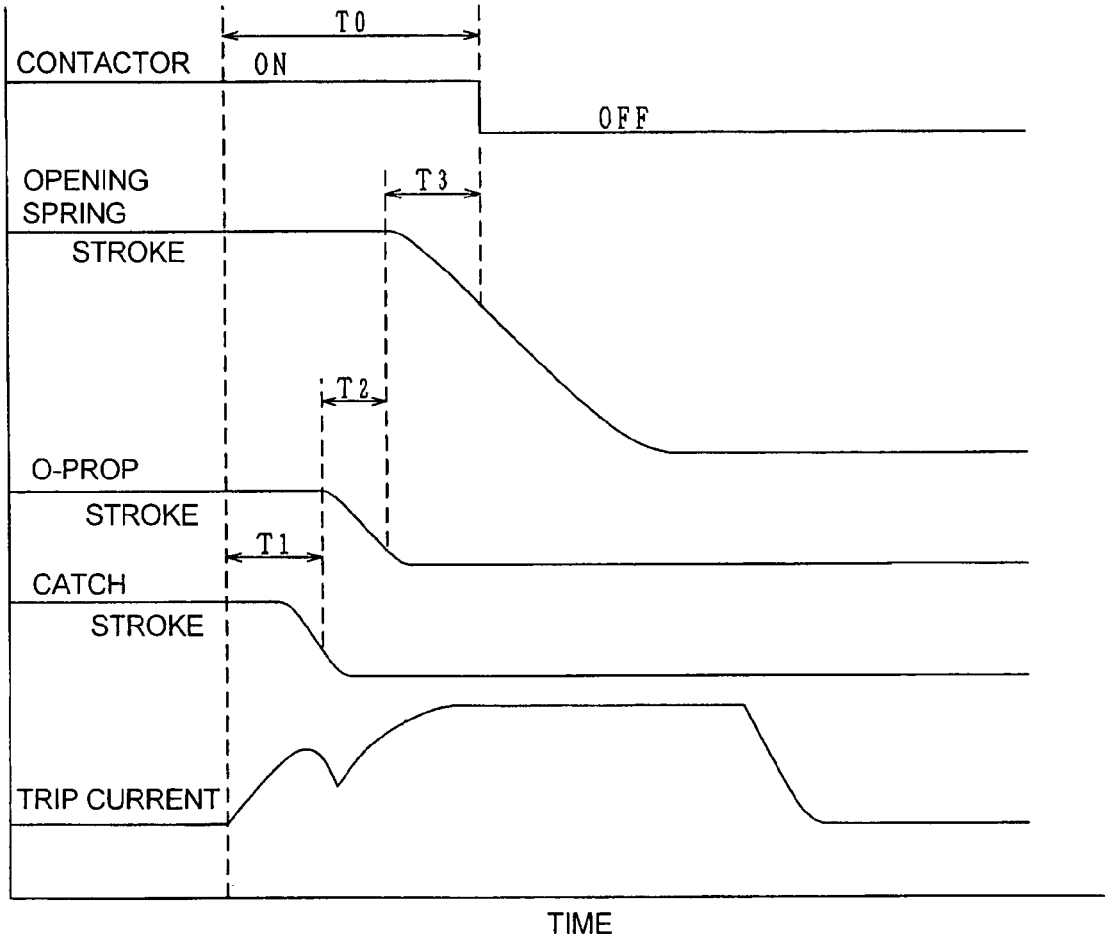
FIG. 10 PRIOR ART
FIG. 10 is a time chart for explaining the opening operation of a conventional switchgear.

Next, with reference to FIG. 9, a third embodiment of a switchgear operating mechanism according to the present invention will be described. In FIG. 9, the same reference numerals as those in the first embodiment denote the same or corresponding parts as those in the first embodiment, and the repetitive description is omitted.

The present embodiment is obtained by modifying the first embodiment such that the functions of the connection pin 51*a* and the lock lever pin 52*d* of FIG. 1 are realized by one connection pin 51*a*. More specifically, as shown in FIG. 9, the kick lever 51 and the lock lever 52 are engaged with each other by one connection pin 51*a*.

The third embodiment having the above configuration can obtain the same effect as the first embodiment. Further, since applying a force to the connection portion between the kick lever 51 and the lock lever 52 is most effective way for reducing a force required for releasing the pressing state between the kick lever 51 and the lock lever 52, the configuration of the third embodiment enables a reduction in the output power of the electromagnet solenoid 21 for opening and a reduction in the size thereof.

Other Embodiments

The embodiments described above are merely given as examples, and it should be understood that the present invention is not limited thereto. For example, although compression coil springs are used as the opening spring 12 and the closing spring 13 in the above embodiments, other elastic bodies, such as torsion coil springs, disc springs, spiral springs, plate springs, air springs, and tension springs may be used alternatively. Further, although a coil spring or torsion coil spring is used as the return springs 91*a*, 51*b*, and 54*a* provided in the latch 91, the kick lever 51, and the pull-off lever 54, other elastic bodies such as disc springs, spiral springs, or plate springs may used alternatively.

The present invention can also be applied to an apparatus having a plurality of opening springs or plurality of the closing springs.

Further, although the stopper pin 90*a* for restricting the rotation of the latch 91 also serves as the rotation axis of the kick lever 51 in the above embodiments, the above functions may be provided separately.

Further, the anchoring lever 90 may be omitted. In this case, the stopper pin 90*a* or the like is directly fixed to the frame 14. Further, the stopper pin 90*a* may be integrated with the anchoring lever 90 or the frame 14.

What is claimed is:

1. A switchgear operating mechanism for reciprocatively driving a movable contact of a switchgear so as to shift the switchgear between an open state and a closed state, the operating mechanism comprising:

a frame;

a closing shaft rotatably disposed relative to the frame;

a main lever which is rotatably fixed to the closing shaft and which can be swung in conjunction with the movable contact;

a opening spring which is disposed such that it accumulates energy when the switchgear operating state is shifted from the open state to the closed state in accordance with rotation of the closing shaft while the opening spring discharges its accumulated energy when the switchgear operating state is shifted from the closed state to the open state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which swingably fixed to the sub-shaft;

a roller rotatably fixed to a leading end of the latch lever;

a latch which is disposed so as to be rotated relative to the frame around a rotation axis substantially parallel to the rotation axis of the closing shaft;

a kick lever which is disposed so as to be rotated relative to the frame around a rotation axis substantially parallel to the rotation axis of the latch;

a lock lever which is connected to the latch and the kick lever so as to be rotated around different rotation axes substantially parallel to the rotation axis of the latch;

a latch return spring which biases the latch so as to rotate the latch in a predetermined direction;

a lock lever return spring which biases the lock lever so as to push the latch in the biasing direction of the latch return spring; and a stopper which is fixed to the frame so as to restrict the rotation of the biasing direction of the latch return spring of the latch, wherein in the closed state, the roller pushes the leading end of the latch in the direction substantially toward the rotation center of the latch, and in a state where the switchgear operating state is shifted from the closed state to the open state, the lock lever is pulled so as to allow the latch to be rotated in the opposite direction to the biasing direction of the latch return spring to release an engagement between the roller and the leading end of the latch, which causes the opening spring to discharge its energy to rotate the sub-shaft.

2. The switchgear operating mechanism according to claim 1, wherein the rotation axis of the kick lever, the rotation axis between the latch and the lock lever, and rotation axis between the kick lever and the lock lever are positioned substantially on a same straight line.

3. The switchgear operating mechanism according to claim 1, further comprising a cylindrical connection pin for allowing the mutual rotation between the kick lever and the lock lever disposed at the position corresponding to the rotation axis between the kick lever and the lock lever, wherein a center of the connection pin is arranged within a range of a distance corresponding to the radius of the connection pin from a straight line connecting the rotation axis of the kick lever and rotation axis between the latch and the lock lever.

4. The switchgear operating mechanism according to claim 1, further comprising:

a pull-off link mechanism engaged with the lock lever;

a pull-off return spring for biasing the pull-off link mechanism in a predetermined direction; and an electromagnetic solenoid for opening which drives the pull-off link mechanism against the biasing force of the pull-off return spring to pull the lock lever so as to shift the switchgear operating state from the closed state to the open state.

5. The switchgear operating mechanism according to claim 1, wherein an engagement surface of the latch with the roller is formed in substantially a cylindrical surface, and the axis of the cylindrical surface substantially coincides with the rotation center of the latch.

6. The switchgear operating mechanism according to claim 1, wherein a cylindrical latch shaft pin for allowing the rotation of the latch is disposed at the position corresponding to the rotation axis of the latch, an engagement surface of the latch with the roller is formed in substantially a cylindrical surface, and the axis of the cylindrical surface falls within the radius of the latch shaft pin.

7. The switchgear operating mechanism according to claim 1, further comprising a closing spring which is disposed such that it accumulates energy when the switchgear operating state is shifted from the closed state to the open state in accordance with the rotation of the closing shaft while it discharges its accumulated energy when the switchgear operating state is shifted from the open state to the closed state.

8. The switchgear operating mechanism according to claim 7, further comprising:

a closing lever which is rotatably fixed to the closing shaft; and a closing link which is rotatably connected to the closing lever, wherein the closing spring is disposed between the leading end of the closing link and the frame so as to bias the leading end of the closing link in the direction away from the closing shaft.

9. The switchgear operating mechanism according to claim 7, wherein the kick lever has a kick lever protrusion portion, and when the switchgear operating state is shifted from the open state to the closed state, the latch lever is rotated in the opposite direction to the biasing direction of the lock lever return spring by the cam mechanism in association with the rotation of the closing shaft to cause the roller to push the kick lever protrusion portion, which allows the kick lever to be rotated and the latch lever to be further rotated, causing the latch to be rotated in the direction opposite to the biasing direction of the latch return spring to allow the leading end of the latch to be brought into contact with the roller.

10. The switchgear operating mechanism according to claim 9, wherein a cushioning member is disposed on a surface at which the lock lever and the latch are brought into contact with each other by the biasing force of the lock lever return spring.

11. The switchgear operating mechanism according to claim 8, wherein the lock lever has a lock lever protrusion portion, and when the switchgear operating state is shifted from the open state to the closed state, the latch lever is rotated by the cam mechanism in association with the rotation of the closing, shaft to cause the roller to push the lock lever protrusion portion, which allows the lock lever to be rotated in the direction opposite to the biasing direction of the lock lever return spring and the latch lever to be further rotated, causing the latch to be rotated in the direction opposite to the biasing direction of the latch return spring to allow the leading end of the latch to be brought into contact with the roller.

12. The switchgear operating mechanism according to claim 11, wherein a cushioning member is disposed on a surface at which the kick lever and the latch are brought into contact with each other by the biasing force of the lock lever return spring.

13. The switchgear operating mechanism according to claim 4, wherein a lock lever pin is disposed in the lock lever, the pull-off link mechanism has a pull-off link having an elongated hole engaged with the lock lever pin and a pull-off lever rotatably connected to the pull-off link, and when the electromagnetic solenoid for opening pushes the pull-off lever, the pull-off lever is rotated in the direction opposite to the biasing direction of the lock lever return spring.

14. The switchgear operating mechanism according to claim 1, wherein the lock lever pin is disposed at a position corresponding to a rotation axis between the latch and the lock lever.

15. A switchgear having a movable contact that can be moved in a reciprocating manner and an operating mechanism that reciprocatively drives the movable contact and which can be shifted between an open state and a closed state by the movement of the movable contact, the operating mechanism comprising:

a frame;

a closing shaft rotatably disposed relative to the frame;

a main lever which is rotatably fixed to the closing shaft and which can be swung in conjunction with the movable contact;

a opening spring which is disposed such that it accumulates energy when the switchgear operating state is shifted from the open state to the closed state in accordance with rotation of the closing shaft while the opening spring discharges its accumulated energy when the switchgear operating state is shifted from the closed state to the open state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with the rotation of the closing shaft;

a latch lever which swingably fixed to the sub-shaft;

a roller rotatably fixed to a leading end of the latch lever;

a latch which is disposed so as to be rotated relative to the frame around a rotation axis substantially parallel to the rotation axis of the closing shaft;

a kick lever which is disposed so as to be rotated relative to the frame around a rotation axis substantially parallel to the rotation axis of the latch;

a lock lever which is connected to the latch and kick lever so as to be rotated around different rotation axes substantially parallel to the rotation axis of the latch;

a latch return spring which biases the latch so as to rotate the latch in a predetermined direction;

a lock lever return spring which biases the lock lever so as to push the latch in the biasing direction of the latch return spring; and a stopper which is fixed to the frame so as to restrict the rotation of the biasing direction of the latch return spring of the latch, wherein in the closed state, the roller pushes the leading end of the latch in the direction substantially toward the rotation center of the latch, and in a state where the switchgear operating state is shifted from the closed state to the open state, the lock lever is pulled so as to allow the latch to be rotated in the opposite direction to the biasing direction of the latch return spring to release an engagement between the roller and the leading end of the latch, which causes the opening spring to discharge its energy to rotate the sub-shaft.

* * * * *